US005247274A

United States Patent [19]

Gurevich

[11] Patent Number: 5,247,274

[45] Date of Patent: Sep. 21, 1993

[54] TRIGGER MECHANISM FOR TIME-DELAY FUSES

[75] Inventor: Leon Gurevich, St. Louis, Mo.

[73] Assignee: Cooper Industries, Inc., Houston, Tex.

[21] Appl. No.: 922,686

[22] Filed: Jul. 30, 1992

Related U.S. Application Data

[63] Continuation-in-part of Ser. No. 711,769, Jun. 7, 1991, Pat. No. 5,150,093.

[51] Int. Cl.[5] ..... H01H 85/04

[52] U.S. Cl. ..... 337/164; 337/165

[58] Field of Search ..... 337/163, 164, 165, 166

[56] References Cited

U.S. PATENT DOCUMENTS 4,084,610 9/1977 Jacobs, Jr. ..... 337/165

4,994,779 2/1991 Douglass ..... 337/163

*Primary Examiner*—Harold Broome

*Attorney, Agent, or Firm*—Laff, Whitesel, Conte & Saret

[57] ABSTRACT

A time-delay fuse having a fuse element with a series of weak spots surrounded by a loose sand filler. The fuse element is connected to a trigger mechanism by solder or other meltable alloy. The trigger section provides overload protection and the fuse element provides short circuit protection resulting in a time-delay fuse which can be used in places where there are size restrictions.

19 Claims, 2 Drawing Sheets

TRIGGER MECHANISM FOR TIME-DELAY FUSES

This is a continuation-in-part of my pending application 07/711,769 filed Jun. 7, 1991, now U.S. Pat. No. 5,150,093. This invention relates to fuses in general and in particular to a trigger mechanism for time-delay fuses of the type set forth in my co-pending application.

A time-delay fuse is a type of fuse that has a built in delay that allows temporary and harmless inrush currents to pass without opening, yet is designed to open on sustained overloads and short circuits.

The general characteristics of this type of fuse is desirable in my parent co-pending application which is further incorporated herein. As set forth therein, Underwriter's Laboratories has developed basic physical specifications and electrical performance requirements for fuses with voltage ratings of 600 volts or less. These requirements are known as UL Standards. If a type of fuse meets the requirements of a standard, it will be placed in that UL Class. Typical UL Classes are K-1, K-5, RK-1, RK-5, G, L, H, T, CC, and J.

There is therefore a need in the art for a Class J rated fuse which can utilize a loose sand filler around the fuse element.

SUMMARY OF THE INVENTION

In the present invention, the short-circuit or fusible element is a single non-cylindrical preferably flat fuse strip surrounded by a loose sand filler. A series of weak spots in the fuse element are formed by placing a series of holes in the fuse element. The number of weak spots is greater than the product of the rms voltage of the fuse and 0.01.

A reduction of the resistance of the weak spot has been accomplished by reducing the length of the weak spot ($L_{w.s.}$) from 0.018 inches to 0.013 inches. This reduction of effective length of each weak spot is accomplished by using carbide dies in the stamping process or a photochemical etching. The reduction of effective length of the weak spots allows the fuse element to withstand a 500% overload for more than 10 seconds. These allows the present invention to satisfy the UL requirements for maximum allowable $I^2t$ for a Class J time-delay fuse while employing a loose sand filler.

Because the resistance of the weak spot is directly proportional to the effective length of the weak spot, lowering the effective length of the weak spot also lowers the resistance of that weak spot. This allows more weak spots to be placed along a fuse element without an increase in resistance of that fuse element.

Also, a longer fuse element within the confines of a given fuse tube allows more weak spots in series to be placed along the fuse element and also increases the amount of material to absorb heat from the weak spots during an overload condition. The fuse element is bent approximately 90 degrees in alternating directions to form a zig-zag pattern. These bends are placed between the weak spots. Bends of a less acute angle near the respective ends of the fuse element allow the ends of the fuse elements to connect with the appropriate conducting surface at a practical angle.

The number of weak spots has been increased to eight on the present invention. The number of weak spots required for a given fuse rating is given by the formula:

$$n \geqq \frac{V_{rms}}{100} \text{ rated}$$

Where:

n=number of weak spots.

v=Voltage

Thus, in order to satisfy the UL Class J requirement of 600 volts (rms), the number of weak spots must exceed six. It is the combination of the number of weak spots in excess of six, the shorter effective length of each weak spot, and bending of the fuse element to allow a longer fuse element within a tube that the fuse to perform up to UL Class J standards.

In the overload section of the fuse tube I provide my inventive trigger assembly. The trigger assembly has a heater strip. The heater strip preferably comprises a central portion having a pair of arcuate flanges that extend longitudinally along the inner surface of the tube, and a protuberance formed on the outer surface of each flange that extends longitudinally from the distal end of each flange and terminates near the central portion. The trigger has a trigger head, a trigger body, and a spring extending around the trigger body and abutting the trigger head. The trigger head is bonded to the flanges by a fusible alloy so that the trigger body is electrically connected to the fuse element (i.e. by the fusible alloy) and the spring is in compression. During an overload condition, the fusible alloy melts, and the pressure of the spring on the trigger head pushes the trigger head along the flange and the trigger body away from the fuse element and causes the separation of the trigger from its electrical connection, thereby interrupting the circuit.

FIG. A is a partial cross-sectional side view showing the trigger of the present invention in a position after an overload.

Figure 5:
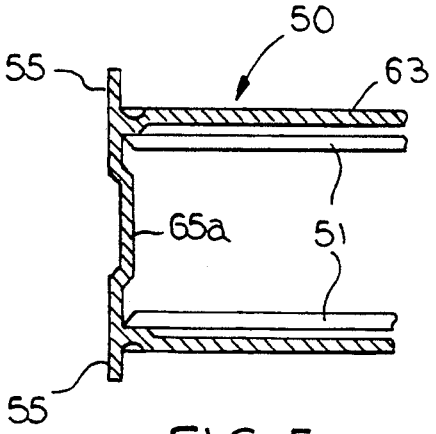
Figure 6:
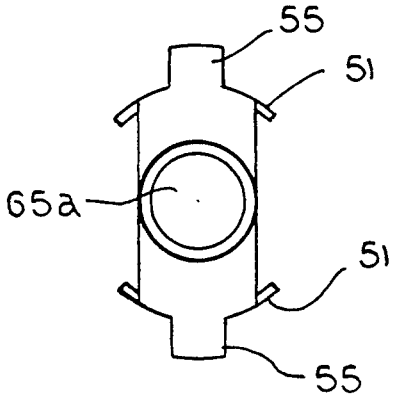

FIG. 5 is a cross section of one embodiment of the heater strip used with the present invention:

FIG. 6 is a top view of the heater strip of FIG. 5.

Figure 2:
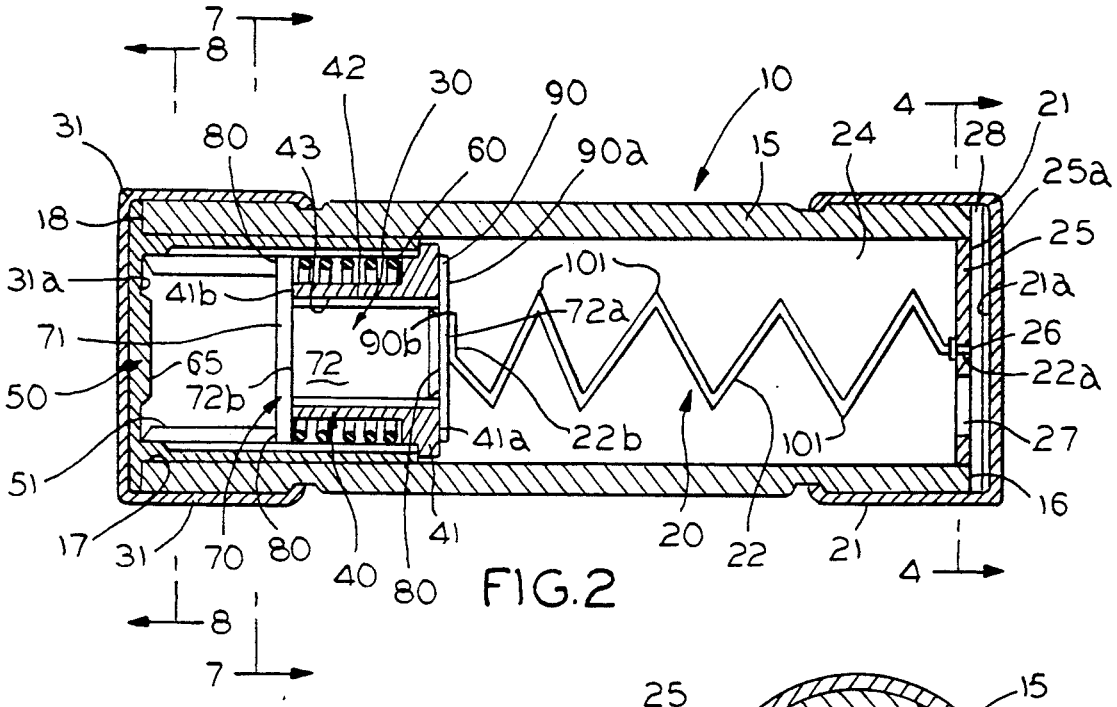
FIG. 2 shows a cross sectional side view of an embodiment of the invention.
Figure 7:
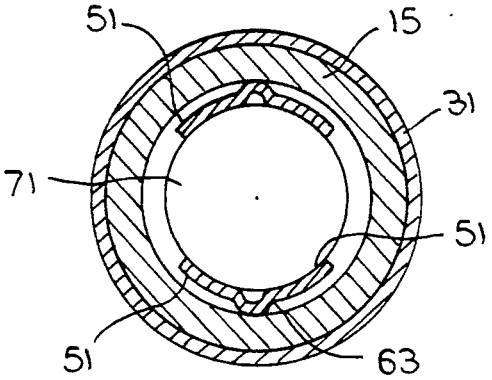

FIG. 7 is a cross section taken along lines 7—7 of FIG. 2.

Figure 8:
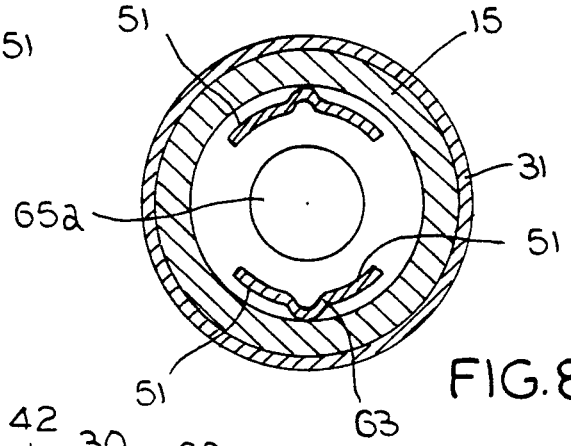

FIG. 8 is a cross section taken along lines 8—8 of FIG.

Figure 9:
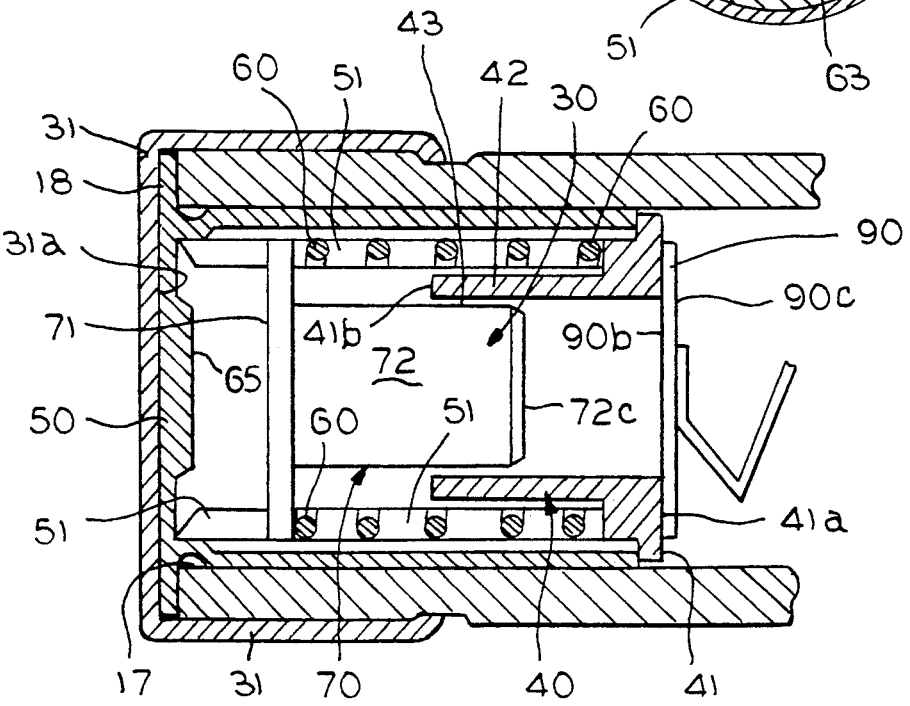

FIG. 9 is an enlarged partial cross-sectional view of the trigger of the present invention separated from a fuse element.

DETAILED DESCRIPTION OF THE INVENTION

Figure 1:
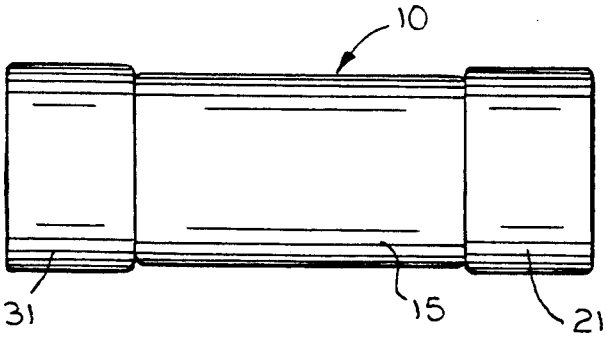
FIG. 1 shows a side view of a fuse of the present invention.

Referring to FIG. 1 there is shown a cartridge fuse 10, having a tubular housing 15 with end caps 21 and 31 Inside this standard sized cartridge fuse are the high interrupting capacity, quick opening response for short circuits, the time-delay overload features of my invention. The end caps 21 and 31 connect the fuse 10 to outside electrical connections. Internal components of the fuse 10 are encased by a tube 15. The tube 15 has an inner surface 17, a tube proximal end 16 and a tube distal end 18. The two main components of the fuse 10, shown in FIG. 2, are a short circuit section 20, and an over load section 30.

Figure 3:
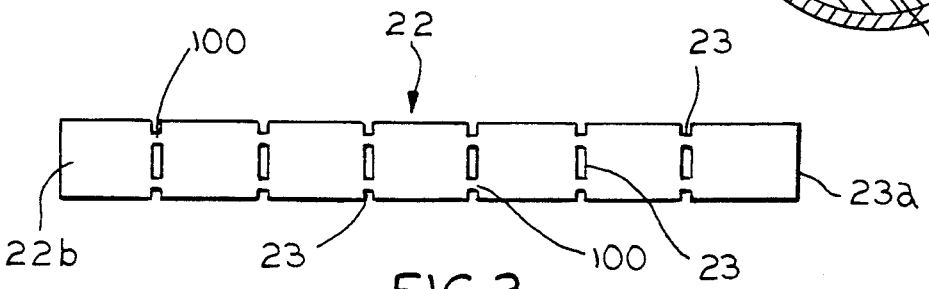
FIG. 3 shows a plan view of a fusible element.

The short circuit section 20 is comprised of a fuse element 22 formed in a flat strip. As shown in FIG. 3, fuse element 22 has a proximal end 22*a* and a distal end 22*b* and has holes 23 which provide weak spots 100 in fuse element. The number of weak spots 100 must be greater than the product of the voltage rating (rms) and 0.01. Further, the spacing between the weak spots 100 must be sufficient to prevent communication of the arcs formed during the short circuit event. The holes 23 are constructed and arranged to give each weak spot 100 an effective length of approximately equal to or less than 0.018 inches.

The short circuit section of the fuse 10 is sealed by an electrically insulating end washer 25 having a proximal side 25*a*. The end washer 25 is constructed and arranged to fit within said inner surface 17 of the tube 15. The end washer 25 has a hole 27 to allow the insertion of loose sand filler into said tube. This end washer 25 may be used to confine the short circuit section. An aperture 26, as shown in FIG. 4, is necessary to allow a portion of the fuse element 22 to protrude through the end washer 25 to allow the fuse element 22 to be electrically connected to the proximal endcap 21 inner surface 21*a*.

Figure 4:
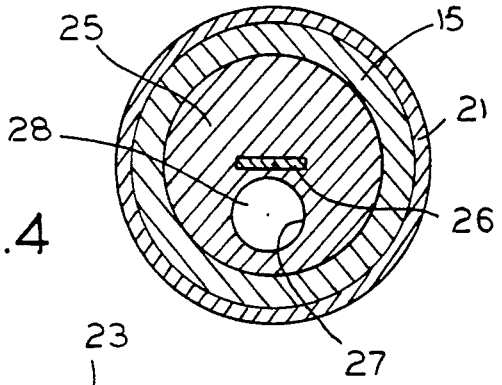
FIG. 4 shows an end view, along lines 4—4 of FIG. 2.

A filler 24, such as stone sand or quartz sand, is added to the fuse 10 through the opening 27 in the end washer 25 as shown in FIG. 4. After addition of the filler 24, an electrically conducting cap washer is constructed and arranged to seat against the proximal end 16 of tube 15 and the end washer 25. The cap washer 2 also is constructed and arranged to fit within the proximal endcap 21 in order to electrically connect the proximal end 22*a* of said fuse element to the inner surface 21 of the proximal endcap 21 when endcap 21 is placed around the tube proximal end 16. In an alternate embodiment of the invention, the endcap 21 is placed directly over the end washer 25, covering the opening 27 and establishing electrical contact with the fuse 5 element 22.

A series of bends 101 are placed along the length of the fuse element 22, between the weak spots 100. Use of bends 101 allows a longer fuse element 22 to fit within the confines of the tube 15. One of the benefits of a longer fuse element 22 is the increased number of weak spots 100 which may be provided along the fuse element 22. A longer fuse element 22 also results in more material to absorb heat from the weak spots 100 during an overload condition. A longer fuse element 22 also allows more heat to be transferred from the fuse element 22 to the loose sand filler 24. It is important that the heat generated by normal or nominal overload conditions be transferred away from the weak spots 100 in order to prevent unwanted circuit interruption at low overloads typical of the start up of motor operation.

The bends 101, as shown in FIG. 2, are alternated to form a zig-zag pattern and are made between the weak spots 100. Bends 101, generally, should not be made at the weak spots 100 because the absolute length of the weak spot 100 would be shortened an amount equal to the product of the original unbended length and the sine of the bend angle. This would allow an arc to last longer during a short circuit event and thereby degrade the performance of the fuse 10.

In a short circuit situation, the current passing through the fuse 10 is high enough to melt through the weak spots 100 in element 22 thus interrupting current through the fuse 10. By using the weak spot design for the fuse element 22 of the present invention, a loose sand filler 24, as shown in FIG. 2, can be employed to accomplish fast and reliable clearing of the fuse 10 during a short circuit event.

FIG. 2 shows the overload section 30 separated from the short circuit section 20 by a washer 90 electrically connected to fuse element distal end 22*b*. A spacer 40 having a hollow center 43 is located adjacent the washer 90 opposite the fuse element, and a spring 60 is placed around the body 42 of the spacer. Also contained within the overload section is a trigger assembly comprising a trigger head 71, a trigger body 72 and a spring 60. During non-overload operating conditions, the trigger body 72 is housed within the hollow center 43 of the spacer 40 and is in electrical connection with the washer 90, and the spring 60 is compressed around the trigger body and spacer. One end of the spring 60 abuts the trigger head 71, as shown in FIG. 2.

A heater strip 50 is positioned in the overload section 30 along the inner surfaces 17, 18, as shown in FIG. 2. As best shown in FIGS. 5–9, the heater strip comprises an end portion 52 and a pair of arcuate flanges 51 extending from the end portion 52. The flanges 51 are arcuate to compliment the round trigger head 71 and provide a passageway 61 for the trigger head. A protuberance 63 is formed in each flange and extends longitudinally along the outer central portion of each flange for substantially the entire distance of the flanges. The protuberances 63 abut the inner surfaces of the tube and reduce the surface area contact between the heater strip 50 and the inner surfaces 17, 18 of the tube 10. The end portion of the flange comprises a cushion against which the trigger impacts. The cushion may be in the form of a boss 65 formed on the bottom of the central portion, as shown in FIG. 2, or a depression 65*a*, as shown in FIGS. 5–8.

The trigger 60 is held in place and spring 60 is held in compression during a non-overload condition by bonding the trigger head 71 to the heater guide flanges 51 with a fusible alloy 80.

The electrically insulating spacer 40 has a proximal end 41*a* and a distal end 41*b*. The spacer has a spacer head 41 at the proximal end 41*a*. The spacer head 41 has an outside diameter approximately equal to the inner surface diameter of the tube. The spacer 40 has a spacer body 42. The spacer body has an outside diameter less than the outside diameter of the spacer head. The spacer 40 also has a hollow center 43 from its proximal end 41*a* to its distal end 41*b*.

The trigger body 72 has a proximal end 72*a* and a distal end 72*b*, the trigger head 71 is at the distal end 72*b*. The trigger head 71 is constructed and arranged to contact the flange 51 of said heater strip and constructed to be guided by the guide flange 51 when the head 71 is moved relative thereto. The trigger body 72 is constructed and arranged to fit within said hollow center 43.

The electrically conducting washer 90 has a proximal side 90*a* and a distal side 90*b* which seats against said proximal side 41*a* of the spacer. The distal side 90*b* of the washer further engages the proximal end 72*a* of the trigger body 72, the proximal end 90*a* of the washer is electrically connected to the distal end 22*b* of said fuse element.

The fusing alloy 80 physically and electrically connects the trigger to the heater strip and electrically connects the trigger to the washer 90. The fusing alloy 80 melts when heated to a prescribed temperature. During an overload condition, the fusible alloy melts which allows the spring to exert pressure on the trigger head 71 and forces the trigger proximal end 72*a* to physically and electrically disconnect from washer 90, thereby electrically disconnecting from the fuse element. Thus, during an overload condition, the circuit is interrupted.

FIG. 9 shows the trigger 70 along the guides 51 when the alloy 80 is melted. The trigger 70, of course, will continue until the head 71 reaches heater end 65.

It is appreciated that the flanges may take on any configuration. For example, it is not necessary that there be a pair of flanges——there could instead be one flange or three or more flange. In addition, it is not necessary that the flanges be arcuate; rather, it is only necessary that the flanges be shaped to provide a passageway 61 for the trigger head 71. Thus, if the trigger head 71 is not round, for example, the flanges perhaps would be shaped to accommodate the head.

The fusible alloy 80 is also used to attach the trigger body 72 to the connecting washer 90. The washer 90 is also connected to fuse element 22, and makes a series connection between the over load section 30 and the short circuit section 20. An endcap 31 is placed over the end 18 of tube 15 and attached to heater strip 50 to complete the circuit.

The heater as shown has a pair of tabs 55 to permit the heater to be inserted into the tube 15 and to rest on the tube end as shown in FIG. 2. The tabs may be replaced by a washer attached to the heater and or any configuration which would allow electrical contact between the end cap 31 and the heater 50.

The fusible alloy 80 must be capable of conducting electricity. In the present invention the alloy 80 comprises a mixture of 42% tin and 58% bismuth. This ratio of tin to bismuth gives the alloy 80 a melting temperature of 138 degrees Celsius. The melting temperature desired is a function of the overload current which fuse 10 must be capable of withstanding. An overload condition of sufficient magnitude will cause heat to be generated by the heater. The heat is conducted to the alloy so to melt or weaken the alloy 80 which bonds the trigger 70 to the heater guide flange 51 and the trigger body 72, thus allowing the spring 60 to force the trigger 70 to separate from the washer 90, interrupting the current passing through the fuse 10. The melting temperature may be changed by employing a different alloy.

I claim:

1. A fuse comprising:

a hollow tube having first and second tube ends;

a fuse element disposed within the tube;

a heater strip disposed within the tube having at least one flange;

a trigger disposed within the tube and constructed and arranged to contact said at least one flange, said trigger being electrically connected to one end of said fuse element;

a fusing alloy connecting said trigger to said at least one flange, said fusing alloy adapted to melt when heated to a prescribe temperature;

an electrically insulating spacer disposed within the tube, said spacer having a spacer head and a spacer body;

an electrically conducting washer disposed between said spacer body and said fuse element and electrically connecting said trigger to said first end of said fuse element end; and a spring constructed and arranged to fit around at least a portion of said trigger and being held in compression when said fusing alloy is not melted, said spring adapted to force said trigger away from said one end of said fuse element when said fusing alloy melts.

2. The fuse of claim 1 wherein said spacer body is hollow and comprises a bore and said trigger comprises a trigger head and a trigger body, said trigger head and said trigger body having concentric and round cross sections, the diameter of the cross section of said trigger head being slightly more than the diameter of said trigger body to define a surface abutting one end of said spring, and said trigger body being received within said bore when said fusing alloy is not melted.

3. The fuse of claim 2 wherein said fusing alloy physically and electrically connects said trigger head to said heater strip.

4. A fuse comprising:

a hollow tube having first and second tube ends;

a fuse element disposed within the tube;

a heater strip disposed within the tube having at least one flange; said heater strip having a central portion and a pair of flanges, said central portion adjacent said first tube end and said pair of flanges extending adjacent portions of opposed inner surfaces of said tube approximately 90 degrees relative to said central portion;

a trigger disposed within the tube and constructed and arranged to contact said at least one flange, said trigger being electrically connected to one end of said fuse element; and a fusing alloy connecting said trigger to said at least one flange, said fusing alloy adapted to melt when heated to a prescribed temperature; and means for disconnecting said trigger from said one end of said fuse element when said fuse alloy melts.

5. The fuse of claim 4 wherein an arcuate protuberance is formed along the outer side of each of said flanges and extends longitudinally from the distal end of each flange and terminates near said central portion, said protuberances being in contact with the inner surfaces of said tube.

6. The fuse of claim 5 wherein said fusing alloy also physically and electrically connects said trigger body to said washer.

7. The fuse of claim 6 wherein said central portion further comprises a cushion, said trigger adapted to impact upon said cushion when said trigger disengages from said one end of said fuse element.

8. The fuse of claim 7 wherein said cushion comprises a boss formed on the bottom side of said central portion.

9. The fuse of claim 7 wherein said cushion comprises a depression formed on the top side of said central portion.

10. A trigger device to be imployed in a fuse, said trigger device comprising:

a heater strip disposed within the fuse tube having at least one flange;

a trigger constructed and arranged to contact said at least one flange and to be electrically connected to a fuse element;

a fusing alloy connecting said trigger to said at least one flange, said fusing alloy adapted to melt when heated to a prescribed temperature;

an electrically insulating spacer, an electrically conducting washer disposed between said spacer and the fuse element to electrically connect said trigger to the fuse element end; and a spring constructed and arranged to fit around at least a portion of said trigger and being held in compression when said fusing alloy is not melted, said spring adapted to force said trigger away from and become electrically disconnected from the fuse element when said fusing alloy melts.

11. The trigger device of claim 10 wherein said spacer is hollow and comprises a bore and said trigger comprises a trigger head and a trigger body, said trigger head and said trigger body having concentric and round cross sections, the diameter of the cross section of said trigger head being slightly more than the diameter of said trigger body to define a surface abutting one end of said spring, and said trigger body being received within said bore when said fusing alloy is not melted.

12. The trigger device of claim 11 wherein said fusing alloy physically and electrically connects said trigger head to said heater strip.

13. The trigger device of claim 12 wherein said fusing alloy also connects said trigger to said washer.

14. The trigger device of claim 10 wherein said heater strip comprises a central portion and a pair of flanges, said central portion being located adjacent one end of the fuse and said pair of flanges extending adjacent opposed inner surfaces of said fuse approximately 90 degrees relative to said central portion.

15. The fuse of claim 14 wherein an arcuate protuberance is formed along the outer side of each of said flanges and extends longitudinally from the distal end of each flange and terminates near said central portion, said protuberances being in contact with the inner surfaces of the fuse.

16. The fuse of claim 15 wherein said central portion further comprises a cushion, said trigger adapted to impact upon said cushion when said trigger disengages from said one end of the fuse element end.

17. The fuse of claim 16 wherein said cushion comprises a boss formed on the bottom side of said central portion.

18. The fuse of claim 16 wherein said cushion comprises a depression formed on the top side of said central portion.

19. A fuse comprising:

a hollow tube having first and second tube ends;

a fuse element disposed within the tube; and means for triggering an interruption of the electric current during an overload condition, said triggering means comprising:

a heater strip disposed within the tube comprising a central portion and a pair of flanges, said central portion adjacent said first tube end and said pair of flanges extending adjacent portions of opposed inner surfaces of said tube approximately 90 degrees relative to said central portion, said central portion comprising a cushion disposed between said pair of flanges;

an arcuate protuberance formed along the outer side of each of said flanges and extending longitudinally from the distal end of each flange and terminating near said central portion, said protuberances being in contact with the inner surfaces of said tube;

a trigger disposed within the tube and constructed and arranged to contact said at least one flange, said trigger comprises a trigger head and a trigger body electrically connected to said fuse element, said trigger head and said trigger body having concentric and round cross sections, the diameter of the cross section of said trigger head being slightly more than the diameter of said trigger body to define a surface;

a fusing alloy connecting said trigger to said at least one flange, said fusing alloy adapted to melt when heated to a prescribe temperature; and means for electrically disconnecting said trigger from said fuse element when said fuse alloy melts, said disconnecting means comprising an electrically insulating spacer disposed within the tube, said spacer having a spacer head and a spacer body, an electrically conducting washer disposed between said spacer body and said fuse element and electrically connecting said trigger to said first end of said fuse element end, and a spring constructed and arranged to fit around at least a portion of said trigger and being held in compression when said fusing alloy is not melted, said spring adapted to force said trigger away from said one end of said fuse element when said fusing alloy melts;

said spacer body being hollow and comprising a bore and said trigger abutting one end of said spring, and said trigger body being received within said bore when said fusing alloy is not melted.

* * * * *